US007000618B2

(12) United States Patent
Dovergne et al.

(10) Patent No.: US 7,000,618 B2
(45) Date of Patent: Feb. 21, 2006

(54) DEVICE FOR APPLYING A SUBSTANCE TO THE HAIR

(75) Inventors: Olivier Dovergne, Ableiges (FR); Christian Revenu, Livry-Gargan (FR)

(73) Assignee: L'Oreal, Paris (FR)

( * ) Notice: Subject to any disclaimer, the term of this patent is extended or adjusted under 35 U.S.C. 154(b) by 316 days.

(21) Appl. No.: 09/960,452

(22) Filed: Sep. 20, 2001

(65) Prior Publication Data

US 2003/0041869 A1 Mar. 6, 2003

(51) Int. Cl.
*A45D 24/22* (2006.01)

(52) U.S. Cl. ..... 132/116; 132/112

(58) Field of Classification Search ..... 132/110–116, 132/120, 208, 901, 320; 401/28, 282, 270, 401/278, 287, 291, 183, 186, 268, 209, 216, 401/176, 179; 222/478, 632, 633
See application file for complete search history.

(56) References Cited

U.S. PATENT DOCUMENTS

| | | | | |
|---|---|---|---|---|
| 4,273,144 | A * | 6/1981 | Morganroth | 132/270 |
| 4,617,875 | A * | 10/1986 | Holland | 119/603 |
| 4,966,175 | A * | 10/1990 | Kimura et al. | 132/112 |
| 5,067,501 | A * | 11/1991 | Auger | 132/116 |
| 5,755,241 | A * | 5/1998 | Cheung | 132/112 |
| 5,937,864 | A * | 8/1999 | Diaz | 132/112 |
| 5,937,866 | A * | 8/1999 | Magharehi | 132/116 |
| 6,000,405 | A * | 12/1999 | De Laforcade | 132/116 |
| 6,062,230 | A * | 5/2000 | Kajgana | 132/116 |
| 6,145,513 | A * | 11/2000 | Chu et al. | 132/112 |
| 6,286,518 | B1 * | 9/2001 | Laporte | 132/116 |
| 6,457,476 | B1 * | 10/2002 | Elmer et al. | 132/114 |
| 6,588,433 | B1 * | 7/2003 | Asano | 132/116 |

FOREIGN PATENT DOCUMENTS

| | | |
|---|---|---|
| DE | 3815601 | 11/1988 |
| DE | 40 14 601 | 11/1991 |
| EP | 1036521 | 9/2000 |
| FR | 2 774 072 | 1/1998 |
| FR | 2 782 614 | 9/1998 |
| JP | 2001190335 | 7/2001 |

* cited by examiner

*Primary Examiner*—Pedro Philogene
(74) *Attorney, Agent, or Firm*—Pearne & Gordon LLP

(57) ABSTRACT

The present invention provides a device for applying a substance to the hair, in particular a hair dye, the device comprising an applicator portion and a receptacle on which the applicator portion is fixed, the receptacle being suitable for containing the substance to be applied, the applicator portion having at least one delivery orifice enabling the substance to be delivered, wherein the applicator portion has teeth arranged around a closed curve, the gaps between the teeth being such that they allow hairs to pass between the teeth while enabling the substance to be retained within said curve, in particular by capillarity.

62 Claims, 5 Drawing Sheets

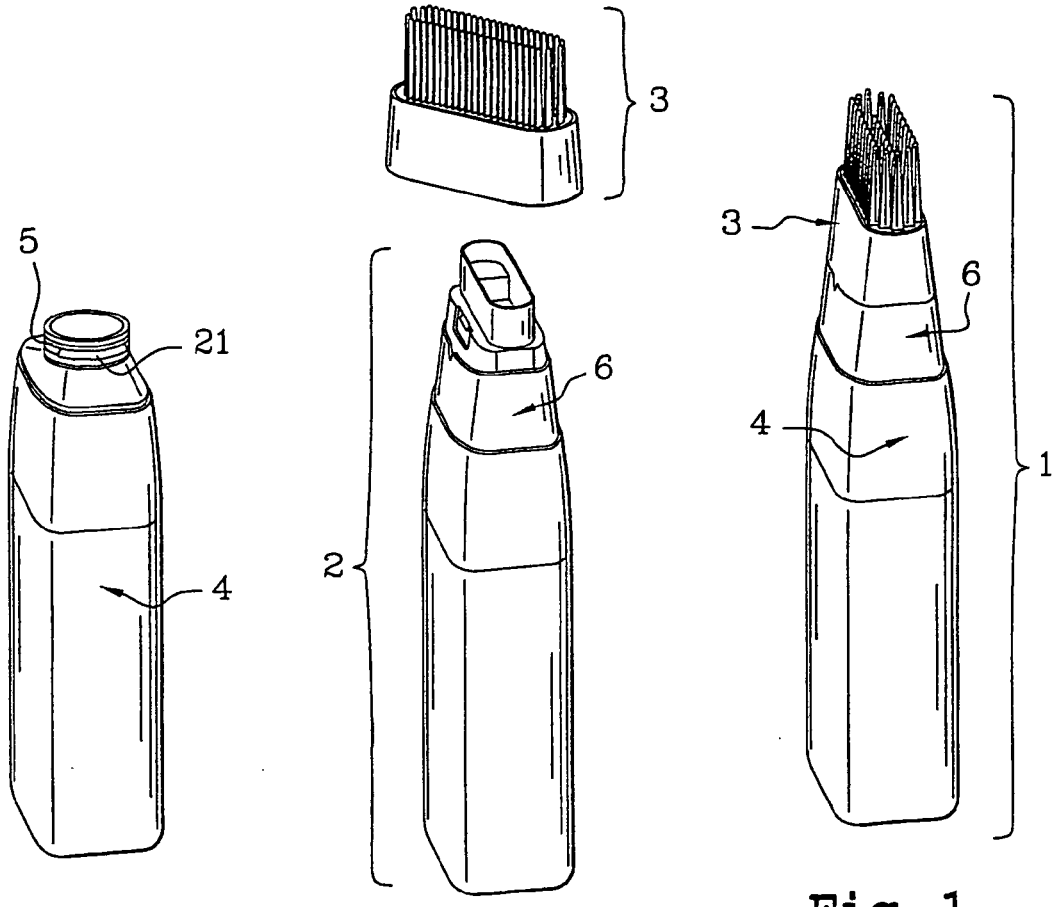
Fig. 2
Fig. 3
Fig. 1
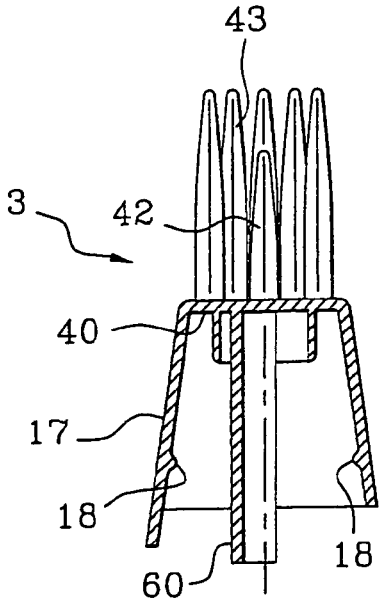
Fig. 17

DEVICE FOR APPLYING A SUBSTANCE TO THE HAIR

The present invention relates to a device for applying a substance to the hair, in particular a substance for dying hair.

BACKGROUND OF THE INVENTION

Numerous devices are known that comprise a receptacle and an applicator portion having teeth, with orifices opening out to the base of the teeth for the purpose of dispensing the substance contained in the receptacle onto the hair of the head.

Particular mention can be made of German patent application DE 40 14 601 and of French patent applications FR-A-2 774 072 and FR-A-2 782 614. The latter application describes an example of a device comprising two outer rows of rectilinear teeth having an intermediate row of teeth of smaller height between them. Such a configuration greatly improves application, particularly by reducing the risk of the substance being applied directly to the scalp and giving rise to irritation.

OBJECTS AND SUMMARY OF THE INVENTION

There exists a need to further improve such a device, in particular to make the result of dying more uniform and/or to enable locks to be treated, where appropriate.

The invention satisfies this need by providing a novel device for applying a substance to the hair, in particular a hair dye, the device comprising an applicator portion and a receptacle on which the applicator portion is fixed, the receptacle being suitable for containing the substance to be applied, the applicator portion having at least one delivery orifice enabling the substance to be delivered.

According to an aspect of the invention, the applicator portion has teeth arranged around a closed curve, the gaps between the teeth being such that they allow hairs to pass between the teeth, while enabling the substance to be retained within said curve, in particular by capillarity.

The invention makes it possible to achieve application that is more uniform, by making it more difficult for the substance that is delivered through said at least one orifice inside said curve to escape through the sides of the applicator portion.

This reduces the risk of smudging or running through the sides.

In a particular embodiment, the applicator portion comprises two outer rows of teeth and at least one intermediate row of teeth situated between said outer rows.

Advantageously, the applicator portion includes teeth of different heights.

The two outer rows meet around the ends of said at least one intermediate row. Thus, by meeting around said at least one intermediate row, the outer rows extend around a closed curve and any escape of the substance from the ends of said at least one intermediate row is made more difficult.

Furthermore, it is possible to treat locks by using the teeth where the outer rows meet, the applicator portion then being moved generally perpendicularly relative to said at least one intermediate row, with the user having previously taken care to engage one or other of the ends of the applicator portion with the locks to be treated.

The term "curve" must be understood broadly and extends to cover a succession of teeth placed along a path including one or more rectilinear segments, the path forming a polygon that can optionally be regular, for example a rectangle or a lozenge, in particular.

In a particular embodiment, the above-specified curve is generally oval.

In a particular embodiment, the two outer rows have rectilinear portions which are united by series of teeth whose bottom regions extending from their bases overlap when the applicator portion is observed in a direction parallel to said rectilinear portions.

In a particular embodiment, the applicator portion is removable, suitable for being fixed on the receptacle both in a first position and in a second position different from the first, the receptacle and the applicator portion being arranged in such a manner that in the first position said at least one delivery orifice does not communicate with the substance contained in the receptacle, thus enabling the receptacle to be shaken to ensure that its content is thoroughly mixed without any risk of leakage through said orifice. In the second position, said at least one delivery orifice communicates with the substance contained in the receptacle, thereby enabling the substance to be applied to the hair.

In particular, the applicator portion can be capable of being fixed in only two different positions on the applicator portion, with transition from one position to the other being performed by removing the applicator portion, turning it through 180° about an axis of the receptacle, and then putting it back into place. This makes the device very simple to use.

In a particular embodiment, the applicator portion has only three rows of teeth, namely the two outer rows of teeth and the intermediate row of teeth, all of the teeth in the intermediate row optionally being shorter than those in the outer rows, and the various rows of teeth possibly being arranged in accordance with the teaching of above-cited application FR-A-2 782 614. The teeth in the intermediate row can be 4 millimeters (mm) to 8 mm shorter than the teeth in the outer rows, with the teeth in the outer rows possibly being constant in height.

In a particular embodiment, the teeth of the outer rows and of the intermediate row are superposed when the applicator portion is observed in a direction parallel to a direction recommended for displacement of the applicator portion relative to the hair, and in particular in a direction perpendicular to the axis of the intermediate row. The rows of teeth, and in particular the outer rows, can also be offset in such a manner as to form baffles.

Still in a particular application, the teeth of the outer and intermediate rows can be oblong in cross-section, e.g. having their major axes perpendicular to the axis of the intermediate row. Such a disposition makes it easier to move the applicator portion through the hair when all of the hair of the head is to be treated rather than treating locks only, and it increases the area of contact between the hair and the teeth.

The applicator portion can have a plurality of substance delivery orifices which can be circular in section, thus not weakening the wall to which the teeth are connected.

The delivery orifices preferably open out to the inside of the above-mentioned curve between the rows of teeth.

The applicator portion can include an internal sealing lip suitable for pressing against a skirt of the receptacle when the applicator portion is in place thereon, said internal sealing lip defining an internal space that is permanently in communication with the outside through said at least one substance delivery orifice. The internal sealing lip can be of oblong cross-section, so as to spread the substance over the entire width of the applicator.

In a particular embodiment, the receptacle has at least one substance delivery duct in communication with said at least one delivery orifice. The delivery duct can have an axial end that is closed and a side that is open. The applicator portion can have a shutter suitable for shutting the side opening when the applicator portion is in a predetermined position relative to the receptacle. The shutter can be constituted by a cylindrical wall of circularly arcuate cross-section.

The applicator portion can be suitable for being fixed on the receptacle by snap-fastening.

The receptacle can comprise a container and an adapter portion to enable the applicator portion to be fixed on the receptacle. In a first variant, the receptacle is made integrally with the adapter portion.

Alternatively, the adapter portion can be constituted by a part made independently from the container and fixed thereto. The adapter portion can include a sealing skirt defining a housing with at least one substance delivery duct opening out into the bottom of the housing. The housing can have a central region and side regions, the central region being deeper than the side regions. In a particular embodiment, the applicator portion can include a single duct opening out into the bottom of the above-mentioned central region.

The adapter portion can include both a covering skirt suitable for extending around a container neck and a receiver skirt for receiving the applicator portion, said receiver skirt possibly meeting an assembly skirt of the applicator portion via a shoulder. The skirt for receiving the applicator portion can include at least one catch in relief for retaining the applicator portion. The applicator portion can present two main faces and have a recess formed in each of said faces. The applicator portion then includes an index suitable for engaging in one of the above-mentioned recesses to inform the user of the position of the applicator portion relative to the receptacle. The adapter portion can also include at least one integrally-molded indicator suitable for enabling the user to identify the position of the applicator portion relative to the receptacle.

In a particular application, an assembly skirt of the adapter portion is shaped in such a manner as to enable the user to deform the assembly skirt by pressing in opposite directions on bearing surfaces so as to change the connection between the applicator portion and the receptacle in order to separate them. The assembly skirt can have large faces with portions in relief suitable for catching on corresponding portions in relief formed on the adapter part, and the adapter part can include flats set back from the assembly skirt and enabling the user to exert pressure on the bearing surfaces of the assembly skirt. The user can thus deform the spacing between the large faces of the assembly skirt in order to disengage its portions in relief from the adapter part. The assembly skirt of the applicator portion can include ribs on its short sides, constituting the above-mentioned bearing surfaces.

In a particular embodiment, the receptacle has a plurality of substance delivery ducts and the applicator portion has a plurality of shutters suitable for engaging in these ducts in order to shut them when the applicator portion is in a first position. These shutters are suitable for taking up positions away from said ducts when the applicator portion is in a second position. The delivery ducts can be placed in non-symmetrical manner about a midplane of the receptacle. The receptacle can include a removable cap at an end opposite from the applicator portion. The cap can be shaped to enable the receptacle to be stood on a plane surface with its applicator portion on top. In a variant, the receptacle need not have a cap at its end opposite from the applicator portion.

Advantageously, the receptacle includes a wall that is compressible. It can be made of polyethylene and the applicator portion can be made of polypropylene, the device being cleanable after each use and reusable.

The invention also provides an applicator portion taken in isolation.

The invention also provides an adapter part, taken in isolation.

The invention also provides a receptacle provided with an adapter portion, taken in isolation.

BRIEF DESCRIPTION OF THE DRAWINGS

Other characteristics and advantages of the present invention will appear on reading the following detailed description of non-limiting embodiments, and on examining the accompanying drawings, in which:

FIG. 1 is a diagrammatic perspective view of an applicator device constituting a first embodiment of the invention;

FIG. 2 shows the container of the FIG. 1 device on its own;

FIG. 3 shows the applicator portion and the container of the FIG. 1 device separately and diagrammatically;

FIG. 17 is a cross-section through the applicator portion;

MORE DETAILED DESCRIPTION

Figure 5:
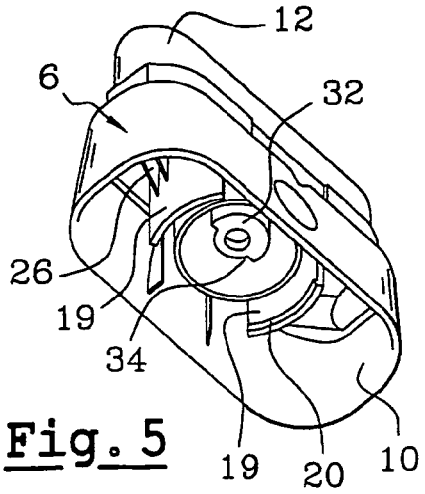
FIG. 5 shows the same part as FIG. 4, as seen in perspective from below.

FIG. 1 shows a device 1 for applying a substance for dying the hair, the device constituting a first embodiment of the invention. As can be seen in FIG. 3, the device 1 comprises a receptacle 2 and an applicator portion 3 that could also be referred to as a "comb" and that is suitable for removably fixing on the receptacle 2. The receptacle is made up of a compressible body or container 4 having a top neck 6 and shown in isolation in FIG. 2, and an adapter portion 6 which is constituted in the example described by a separate part fixed on the container 4. The container is oblong in cross-section having two large faces that can be pressed by the user to cause substance to be delivered.

Figure 4:
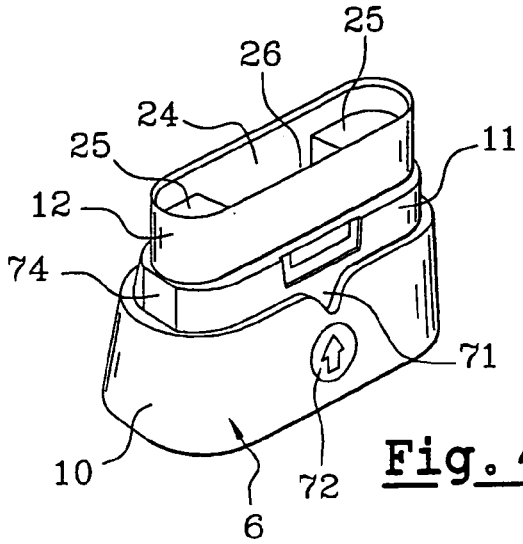
FIG. 4 is a diagrammatic perspective view of the adapter part of the FIG. 1 device as seen from above.
Figure 7:
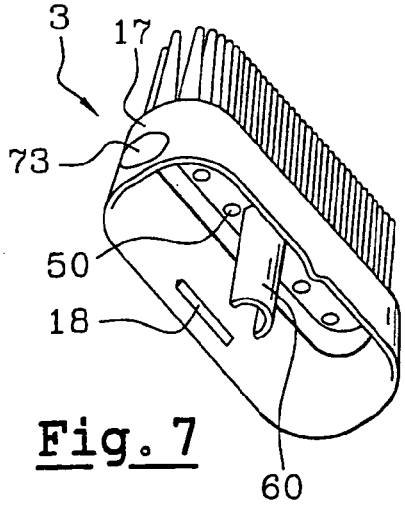
FIG. 7 shows the FIG. 6 applicator portion as seen from below.

FIGS. 4 and 5 show the adapter part 6 in isolation. It comprises a covering skirt 10 for running on continuously from the wall of the container 4, and a receiver skirt 11 for receiving the applicator portion. The receiver skirt 11 is surmounted by a sealing skirt 12 for co-operating in leakproof manner with the applicator portion 3 as described below.

Figure 9:
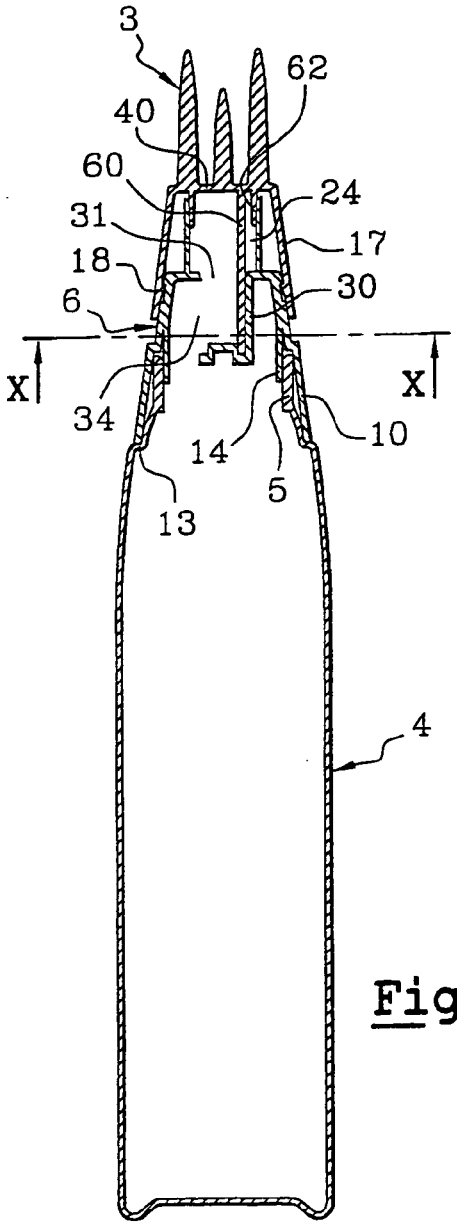
FIG. 9 is a view analogous to FIG. 8, on IX—IX of FIG. 10, the applicator portion being in a delivery position.
Figure 8:
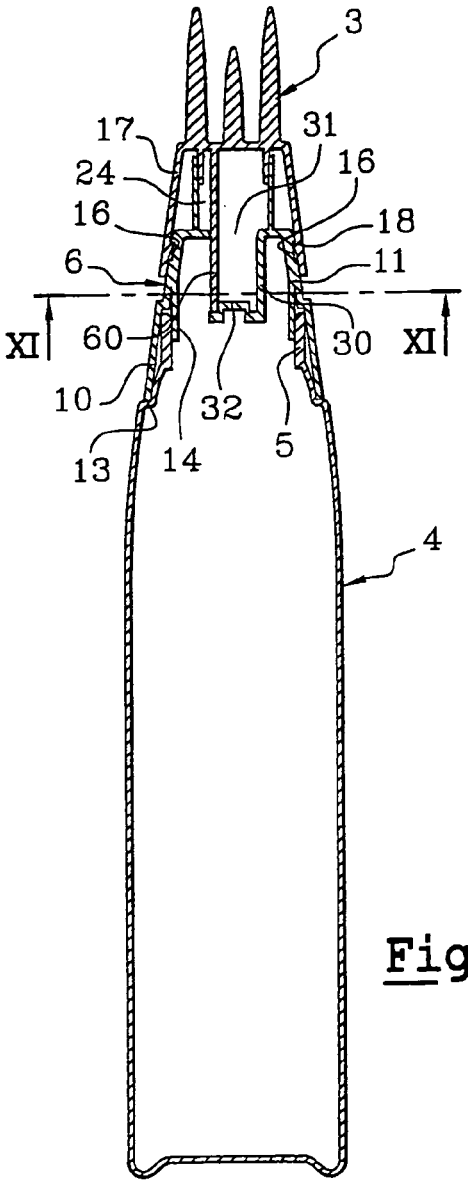
FIG. 8 is a diagrammatic axial section of the FIG. 1 device on VIII—VIII of FIG. 11, the applicator portion being in a shut position.

FIGS. 8 and 9 show that the covering skirt 10 can rest via a bottom edge against a shoulder 13 of the container 4. They also show that the adapter part 6 has a sealing lip 14 which bears in leakproof manner against the inside surface of the neck 5. The sealing lip 14 is connected to the inside surface of the receiver skirt 11.

The covering skirt 10, the receiver skirt 11, and the sealing skirt 12 are all generally oblong in cross-section.

Setbacks 16 are formed in the large faces of the receiver skirt 11 to enable an assembly skirt 17 of the applicator portion 3 to be secured thereto by snap-fastening, said assembly skirt 17 being provided with teeth 18 for this purpose. As can be seen in FIG. 5, in particular, the adapter part 6 also includes two fixing tabs 19 each provided with a tooth 20 suitable for catching on a corresponding rib 21 formed on the neck 5.

Figure 12:
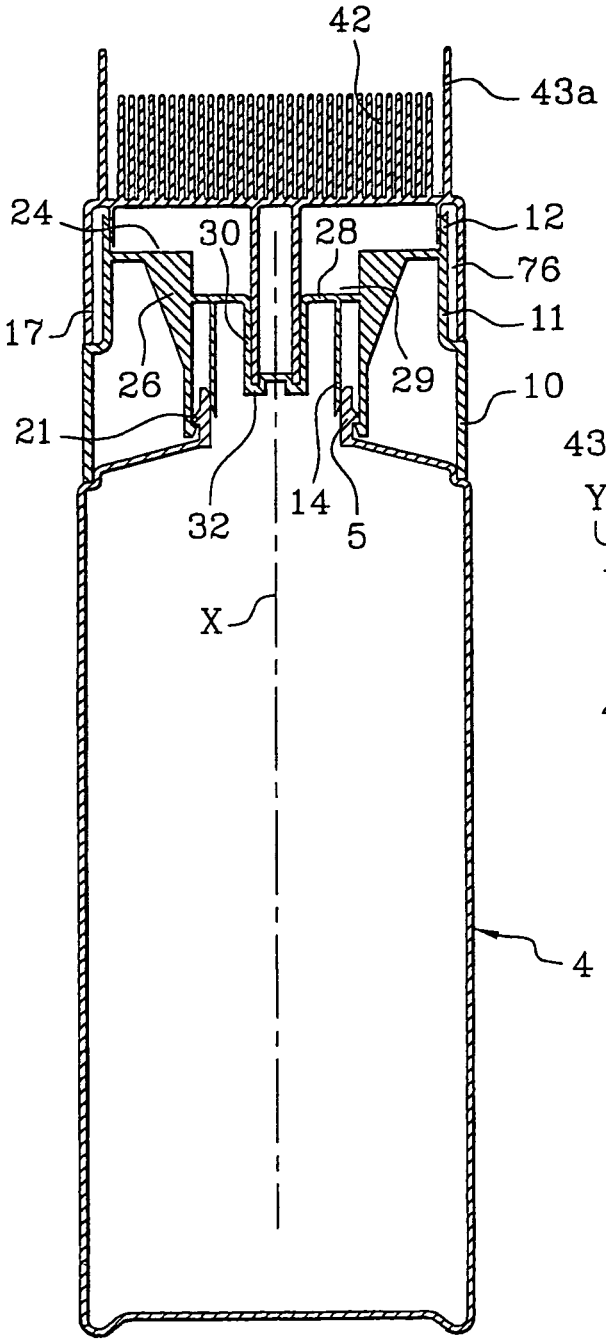
FIG. 12 is an axial section in a section plane perpendicular to that of FIG. 8.

The sealing skirt 12 defines a housing 24 whose bottom comprises two side regions 25 and a central region 26 that is deeper than the side regions 25, as can be seen in FIGS. 4 and 12, in particular.

Figure 10:
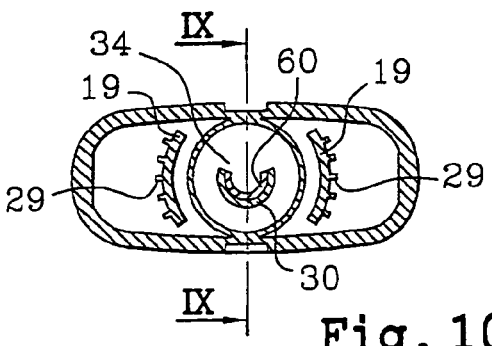
FIG. 10 is a cross-section on X—X of FIG. 9.
Figure 11:
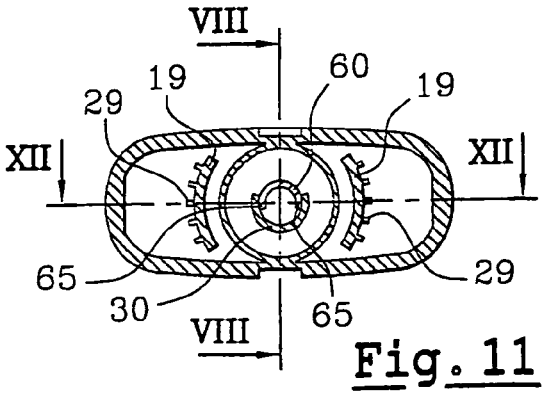
FIG. 11 is a cross-section on XI—XI of FIG. 8.

On their radially outer surfaces, the fixing tabs 19 are provided with stiffening ribs 29 which can be seen in FIGS. 10, 11, and 12. In the central region 26, the bottom wall 28 of the housing 24 is extended downwards by a duct 30 of axis X which opens out via a circular orifice 31 into the housing 24. The duct 30 is closed at its bottom end 32. A side opening 34 whose function is described below occupies nearly the full height of the duct 30.

Figure 13:
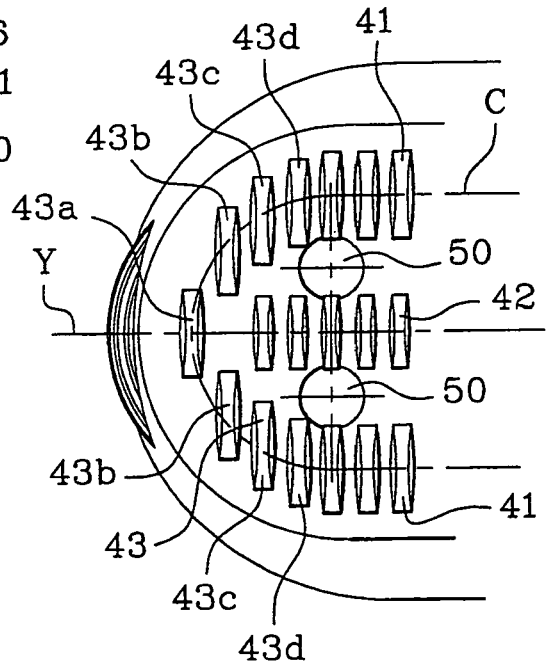
FIG. 13 is a diagrammatic and fragmentary plan view showing the rows of teeth of the applicator portion.
Figure 14:
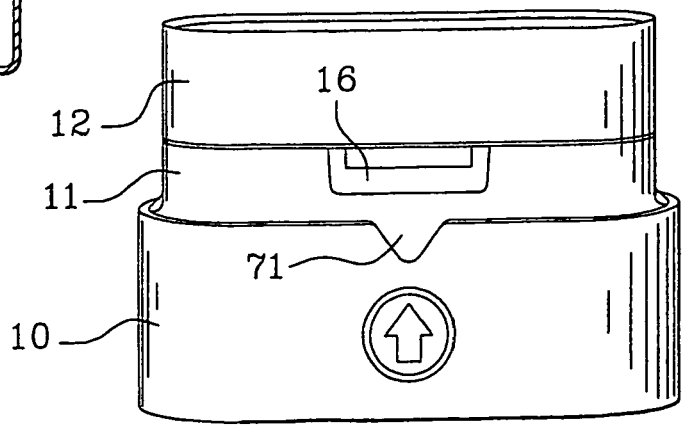
FIG. 14 is a front view of the adapter part shown in isolation.

FIGS. 6, 7, 15, 16, and 17 show the applicator portion 3 in isolation. In addition to the assembly skirt 17, this portion comprises a transverse wall 40 having three rows of teeth connected thereto, namely two outer rows 41 and an intermediate row 42 disposed between the two outer rows 41. The intermediate row 42 extends along a rectilinear axis Y parallel to the major axis of the oblong cross-section of the container 4. The outer rows 41 extend for a major fraction of their length parallel to the axis Y of the intermediate row 42 and they come together around the ends thereof via two series 43 of teeth disposed along a curved path, as can be seen in detail in FIG. 13, the teeth of the rows 41 thus following a closed curve C marked as a dashed line in FIG. 13 and of generally oval shape in this example. In particular, each series 43 comprises teeth 43*a*, 43*b*, 43*c*, and 43*d* that are identical to the teeth of the rectilinear portions of the rows 41 and that are offset progressively towards the midplane containing the axis Y, as can be seen in FIG. 13. Thus, the device 1 has at least one tooth whose base is situated between the axis of the rectilinear portion of an outer row 41 and the axis of the intermediate row 42.

It will be observed that the spacing between the centers of the bases of the teeth in either series 43 as measured parallel to the axis Y is constant and equal to the distance between the centers of the bases of the teeth in the rectilinear portions of the rows 41. In addition, the teeth of the rectilinear portions of the rows 41 and of the series 43 are identical, each having a base of rectangular cross-section with long sides perpendicular to the axis Y. Each tooth of the intermediate row 42 has a base cross-section which is likewise rectangular, with long sides perpendicular to the axis Y. The teeth in the rows 41 and 42 taper only very slightly in thickness going from their bases to their free ends, whereas in width, as measured perpendicularly to the axis Y, they taper to a greater extent, as can be seen in FIGS. 8 and 9. The teeth in the intermediate row 42 are shorter than the teeth in the outer rows 41 by about 6 mm in the example described, with the invention naturally not being limited to this particular value. The spacing between the teeth in the intermediate row 42 is the same as the spacing between the teeth in the rectilinear portions of the outer rows 41, with two consecutive teeth being spaced apart at their bases by 0.45 mm in the example described, with this value naturally not being limiting. The spacing between the rows of teeth measured in a midplane perpendicularly to the axis Y is selected as a function of the nature of the substance, and in particular of its viscosity, and can be about 5 mm, for example.

In the example described, the intermediate row 42 has 32 teeth and the two outer rows 41, including the series 43, make up a total of 70 teeth.

Figure 15:
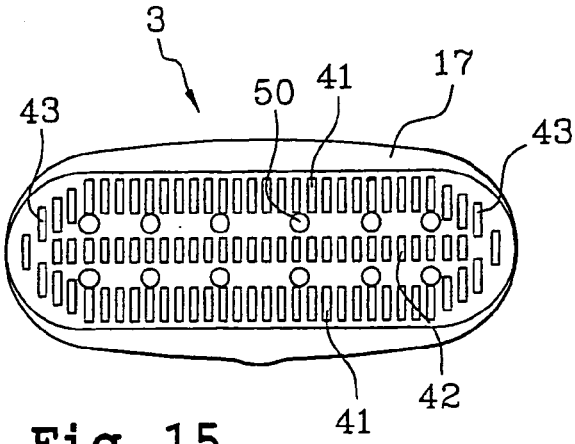
FIG. 15 is a view of the applicator portion seen from above.
Figure 16:
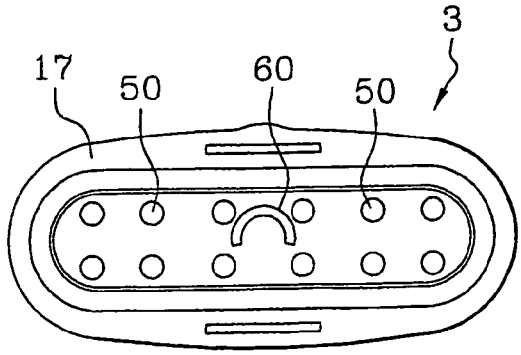
FIG. 16 is a view of the applicator portion seen from below.

The transverse wall 40 is pierced by a plurality of orifices 50 which are of circular section in the example described. These orifices 50 open out between the intermediate row 42 and the outer rows 41, as can be seen in FIG. 15 in particular. In the example described, the applicator portion 3 has six orifices between the intermediate row 42 and each outer row 41, with the diameter and/or the number of orifices being selected as a function of the viscosity of the substance.

The applicator portion 3 has a shutter 60 which is connected to the transverse wall 40 and which is in the form of a portion of a circular cylinder that is open over an annular sector of less than a semicircle. The applicator portion 3 also has a lip 62 suitable for pressing in leakproof manner against the sealing skirt 12 so as to define an inside volume in communication with the delivery orifices 50. The inside volume can communicate with the inside of the container 4 when the applicator portion 3 is in the delivery position as shown in FIG. 9, i.e. when the shutter 60 is received against the concave wall of the duct 30, as shown in FIG. 10. In the shut position as shown in FIG. 8, the shutter 60 shuts the side opening 34 and bears against the duct 30 so that the orifices 50 are isolated from the inside of the container 4. The container is compressible, so that in use, when the applicator portion is in the delivery position and is pointed downwards, it is possible to expel substance towards the teeth by pressing against the large spaces of the container 4.

Figure 6:
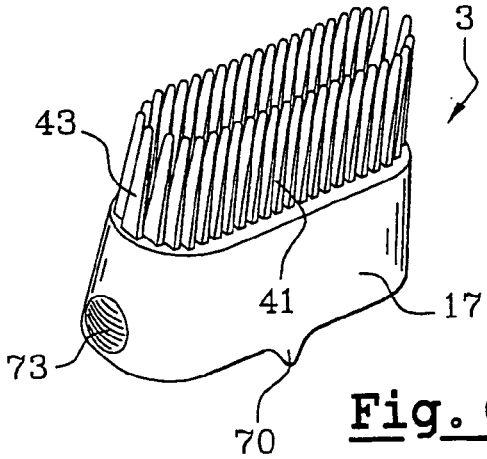
FIG. 6 is a diagrammatic perspective view showing the applicator portion of the FIG. 1 device, as seen from above.

On one of its large faces, the applicator portion 3 includes an index 70 as can be seen in FIG. 6, which index is constituted by an extension of the assembly skirt 17. The covering skirt 10 has a recess 71 of complementary shape on each of its large sides. The index 70 is received in one or other of these recesses 71 depending on whether the applicator portion 3 is in the delivery position or in the shut position. The covering skirt 10 has indications 72 formed during molding so as to distinguish between its two large faces, thereby informing the user whether the applicator portion 3 is in the delivery position or the mixing position.

On its short sides, the applicator portion 3 has ribbed bearing surfaces 73 and the receiver skirt 11 has flats 74 on its short sides, thereby leaving clearance 76 relative to the assembly skirt 17, as can be seen in FIG. 12. Thus, by pressing in opposite directions on the surfaces 73, the user can deform the spacing between the long sides of the assembly skirt 17, thus making it easier to disengage the teeth 18 from the setbacks 16. It is thus relatively easy to remove the applicator portion 3 and this can be done without any risk of detaching the adapter portion 6 from the container 4.

The device 1 is used as follows. It is assumed that it is supplied empty with the applicator portion in the shut position.

The user separates the applicator portion 6 from the container 4, thus revealing the neck 5 and allowing one or more substances for application to the hair to be put into the container, e.g. an oxidizer and a dye. Thereafter, the adapter part 6 is put back into place. Since the applicator portion 3 is in the shut position, the orifices 50 are isolated from the container 4 and the user can shake the container without any danger of substance escaping. After mixing, the user presses on the bearing surfaces 73 in order to remove the applicator portion 3, turns it through 180° above the axis X, and then puts it back into place on the adapter part 6.

In order to treat the hair, the user can move the applicator portion 3 through the hair in a direction perpendicular to the axis Y. The user can also treat locks, still by moving the applicator portion 3 perpendicularly to the axis Y, but while using only the end portions of the comb.

It will be observed that the bottom region of the end tooth 43*a* overlaps the bottom regions of the adjacent teeth 43*b* when the applicator portion is observed by looking along the axis Y of the intermediate row 42.

The container and the applicator portion can be made differently.

Figure 18:
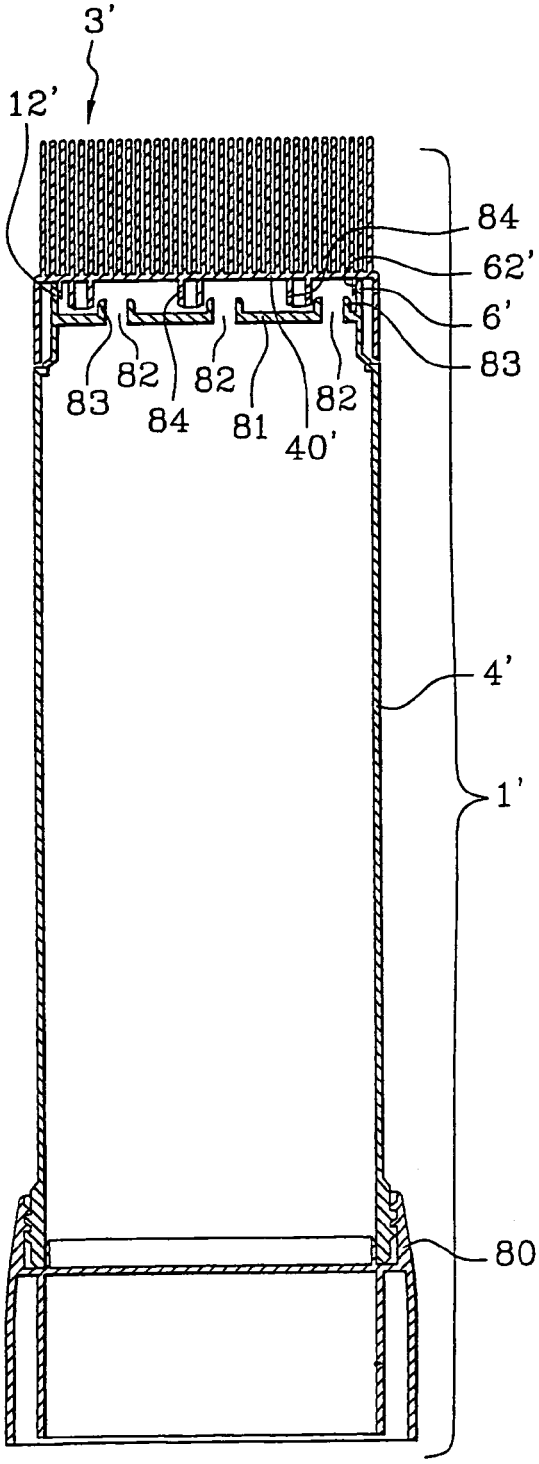
FIG. 18 is a diagrammatic axial section through a device constituting a second embodiment of the invention.
Figure 19:
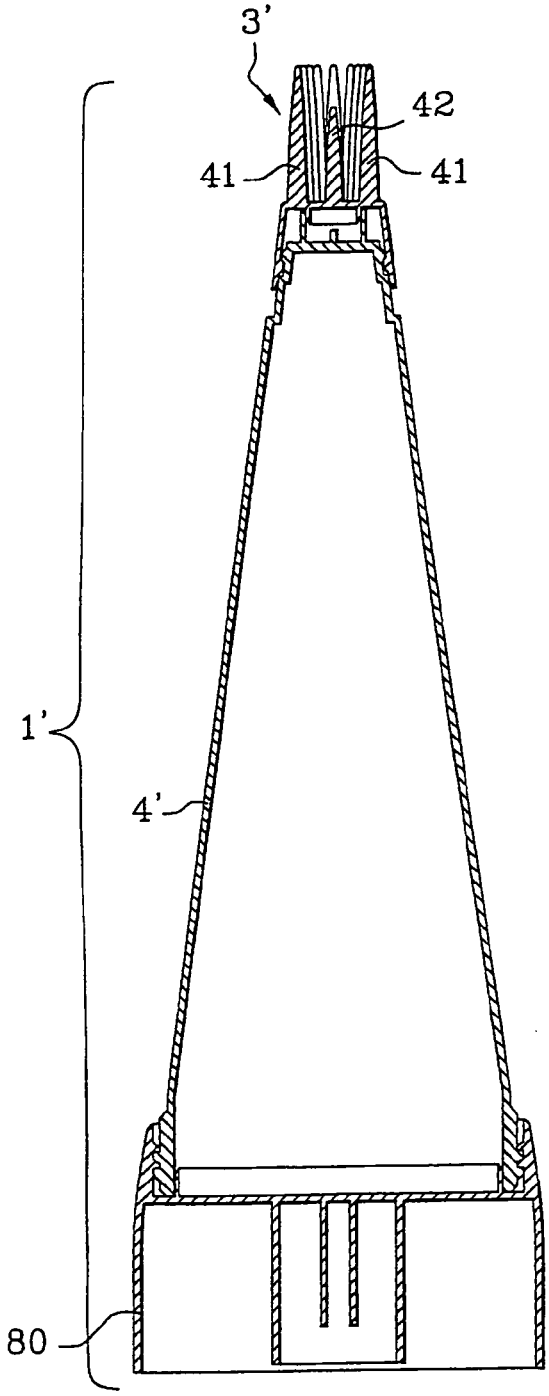
FIG. 19 is an axial section on a section plane perpendicular to that of FIG. 18.

By way of example, FIGS. 18 and 19 show a device 1' in which the adapter portion 6' for fixing the applicator portion 3' is made integrally with the container 4' containing the substance. The bottom portion of the container is provided with a screw cap 80 which enables the container to be filled with the substance that is to be applied. The cap 80 is made so as to enable the device 1' to be stood up stably on a plane surface with the applicator portion 3' on top. The top portion of the container 4' has a transverse wall 81 with orifices 82 passing therethrough, each provided with an upwardly-directed tubular sealing lip 83. The adapter portion 6' of the device 1' also has a sealing skirt 12' which surrounds the transverse wall 81. The applicator portion 3' has a transverse wall 40' carrying the teeth, which are identical to those of the preceding embodiment, and pierced by delivery orifices. Shutter shuts 84 project from the transverse wall 40' in the opposite direction to the teeth. The applicator portion 3' has as many shutter studs 84 as it has orifices 82. The shutter studs 84 are shaped so as to be capable of pressing in leakproof manner against the sealing lips 83 surrounding the orifices 82, thereby shutting them, whenever the applicator portion 3' is in the shut position, i.e. whenever the applicator portion 3' is turned through 180° relative to the position shown in FIG. 18. The applicator portion 3' also has a lip 62' suitable for pressing against the sealing skirt 12' in order to form an inside space into which the delivery orifices open out.

In the delivery position shown in FIG. 18, the shutter studs 84 are offset from the orifices 82 so they do not shut them and the substance can thus flow from the inside of the container 4' towards the teeth via the orifices made through the transverse wall 40'.

Naturally, the invention is not limited to the examples described above.

In particular, the shutter means can be made in various other ways, providing they enable the inside of the container to be isolated from the orifices formed in the applicator portion.

By way of example, the applicator portion can thus be made in such a manner as to allow or prevent fluid communication when the applicator portion is pulled through a certain distance along the axis of the container, without it being necessary for the applicator portion to be turned round, or to be tilted about an axis, e.g. perpendicular to the axis of the container.

Other modifications can be made to the invention without going beyond the ambit of the present invention. In particular, in the examples described, the applicator portion is installed reversibly, i.e. there is no closure capsule broken when the applicator portion is put into the delivery position.

In a variant, a capsule could be provided to be punctured or torn when the applicator portion is moved from the shut position to the delivery position. Such a capsule would make it possible, for example, to supply a container that already contains a substance, e.g. one of the components of a mixture.

In addition, the outer rows of teeth need not have any rectilinear portions. By way of example, they could follow curved or zigzag lines. Similarly, the intermediate row need not extend along a rectilinear axis. The applicator portion can include a plurality of intermediate rows. Within any one row, the teeth can be offset and/or of different heights.

The width of the applicator portion (between its ends) is about 5 centimeters (cm) in the examples described above. This width can be modified without going beyond the ambit of the invention, e.g. by increasing it or by decreasing it to one, two, or three centimeters.

The container can also contain two or three substances for mixing extemporaneously.

What is claimed is:

1. A device for applying a substance to the hair, the device comprising:

a receptacle having a longitudinal axis and configured for containing the substance to be applied, and an applicator portion fixed on said receptacle and having at least one delivery orifice enabling the substance to be delivered, wherein the applicator portion has teeth arranged around a closed oval curve, each tooth having a longitudinal axis, gaps between the teeth being such that they allow hairs to pass between the teeth while enabling the substance to be retained within said curve, and wherein the longitudinal axis of the teeth are substantially parallel to the longitudinal axis of the receptacle.

2. A device according to claim 1, wherein the applicator portion has two outer rows and at least one intermediate row situated between said outer rows, said outer rows meeting each other around said at least one intermediate row.

3. A device according to claim 1, wherein the applicator portion has teeth of different heights.

4. A device according to claim 1, wherein the applicator portion is removable, being configured for fixing on the receptacle in a first position and in a second position different from the first, the receptacle and the applicator portion being configured such that in the first position said at least one delivery orifice does not communicate with the substance contained in the receptacle, and in the second position said at least one delivery orifice communicates with the substance contained in the receptacle.

5. A device according to claim 1, wherein the applicator portion is configured to be fixed on the receptacle in two different positions only, with changeover from one position to the other being performed by removing the applicator portion, turning it through 180° about an axis of the receptacle, and then putting it back into place.

6. A device according to claim 1, wherein the applicator portion has two outer rows of teeth and an intermediate row situated between the two outer rows, with all of the teeth in the intermediate row being shorter than those of the outer rows.

7. A device according to claim 1, wherein the applicator portion has outer and intermediate rows of teeth, said rows superposing one another when the applicator portion is viewed in a direction recommended for moving the applicator portion through the hair.

8. A device according to claim 1, wherein the teeth are of oblong cross-section.

9. A device according to claim 1, having two outer rows of teeth and at least one intermediate row of teeth, the intermediate row having teeth whose free ends are set back from the free ends of the teeth in the outer rows by a distance lying in the range 4 mm to 8 mm, when the applicator portion is observed in a direction perpendicular to the axes of the teeth.

10. A device according to claim 1, wherein the applicator portion has a plurality of substance delivery orifices.

11. A device according to claim 10, wherein said orifices are of circular section.

12. A device according to claim 1, wherein the orifices open out between the rows of teeth.

13. A device according to claim 1, wherein the applicator portion has an internal sealing lip configured for bearing against a skirt of the receptacle when the applicator portion is fixed thereon, said internal lip defining an inside space that is permanently in communication with the outside via said at least one substance delivery orifice.

14. A device according to claim 13, wherein said internal lip is of oblong cross-section.

15. A device according to claim 1, wherein the receptacle has at least one substance delivery duct in communication with said at least one delivery orifice.

16. A device according to claim 15, wherein said delivery duct has an axial end which is closed and a side which is open, and wherein the applicator portion comprises a shutter suitable for shutting said side opening when the applicator portion is in a predetermined position relative to the receptacle.

17. A device according to claim 16, wherein said shutter comprises a cylindrical wall having a circularly arcuate cross-section.

18. A device according to claim 1 wherein the applicator portion is configured for fixing on the receptacle by snap-fastening.

19. A device according to claim 1, wherein the receptacle comprises a container and an adapter portion to enable the applicator portion to be fixed on the receptacle.

20. A device according to claim 19, wherein the adapter portion comprises a part made separately from the container and fixed thereon.

21. A device according to claim 19, wherein the adapter portion has a sealing skirt defining a housing with at least one substance delivery duct opening out into the bottom thereof.

22. A device according to claim 21, wherein said housing has a central region and side regions, the central region being deeper than the side regions, and wherein the applicator portion has a single duct opening out into the bottom of said central region.

23. A device according to claim 20, wherein the adapter portion has a covering skirt configured for extending around a neck of the container, and a receiver skirt for receiving the applicator portion.

24. A device according to claim 23, wherein the receiver skirt of the applicator portion has at least one catch in relief for engaging the applicator portion.

25. A device according to claim 19, wherein the adapter portion has two main faces and comprises a recess formed in each of said faces, and wherein the applicator portion has an index, said index being suitable for engaging in one or other of the said recesses to inform the user about the position of the applicator portion relative to the receptacle.

26. A device according to claim 19, wherein the adapter portion has at least one indication molded therein for enabling the user to identify the position of the applicator portion relative to the receptacle.

27. A device according to claim 19, wherein the applicator portion has an assembly skirt and wherein the adapter portion is configured to enable the user to deform the assembly skirt by pressing in opposite directions on bearing surfaces so as to modify the engagement between the receptacle and the applicator portion, for the purpose of removing it.

28. A device according to claim 27, wherein the assembly skirt has large faces with catches in relief suitable for engaging corresponding catches in relief formed on the adapter potion, and wherein the adapter portion has flats set back from the assembly skirt enabling the user to exert pressure on the bearing surfaces of the assembly skirt so as to enable the user to deform the spacing between the large faces of the assembly skirt to disengage the catches in relief of the assembly skirt from the adapter portion.

29. A device according to claim 27, wherein the assembly skirt of the applicator portion has ribs on its short sides to constitute the bearing surfaces for the user.

30. A device according to claim 1, wherein the receptacle is made integrally with the adapter portion.

31. A device according to claim 1, wherein the receptacle has a plurality of substance delivery ducts and the applicator portion has a plurality of shutters suitable for engaging in said ducts to shut them when the applicator portion is in a first position, and suitable for taking up positions outside said ducts when said applicator portion is in a second position.

32. A device according to claim 31, wherein said ducts are disposed asymmetrically about a midplane of the receptacle.

33. A device according to claim 1, wherein the receptacle comprises a removable cap at an end opposite from the applicator portion.

34. A device according to claim 33, wherein said cap is configured to allow the receptacle to stand on a plane surface with the applicator portion on top.

35. A device according to claim 1, wherein the receptacle does not have a cap at its end opposite from the applicator portion.

36. A device according to claim 1, wherein the receptacle comprises a compressible wall.

37. A device according to claim 1, wherein the receptacle is made of polyethylene.

38. A device according to claim 1, wherein the applicator portion is made of polypropylene.

39. A device according to claim 1, wherein the applicator portion has at least one index enabling its position relative to the receptacle to be identified.

40. A device according to claim 1, wherein the applicator portion has two outer rows of teeth, these rows comprising rectilinear portions which meet each other via series of teeth whose bottom regions extending from their base portions overlap when the applicator portion is observed along a direction parallel to said rectilinear portions.

41. A device according to claim 1, wherein said substance is a hair dye.

42. A device according to claim 1, wherein said substance is retained within said curve by capillarity.

43. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the applicator portion is removable, being configured for fixing on the receptacle in a first position and in a second position different from the first, the receptacle and the applicator portion being configured such that in the first position said at least one delivery orifice does not communicate with the substance contained in the receptacle, and in the second position said at least one delivery orifice communicates with the substance contained in the receptacle.

44. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein said receptacle has a skirt and the applicator portion has an internal sealing lip configured for bearing against said skirt of the receptacle when the applicator portion is fixed thereon, said internal lip defining an inside space that is permanently in communication with the outside via said at least one substance delivery orifice and that is capable of being isolated from an inside of the receptacle.

45. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the receptacle has at least one substance delivery duct in communication with said at least one delivery orifice, said delivery duct having an axial end which is closed and a side which is open, and wherein the applicator portion comprises a shutter suitable for shutting said side opening when the applicator portion is in a predetermined position relative to the receptacle.

46. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the receptacle comprises a container and an adapter portion to enable the applicator portion to be fixed on the receptacle, the applicator portion being removable mounted on the adapter portion, said adapter portion having a sealing skirt defining a housing with at least one substance delivery duct opening out into the bottom thereof.

47. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the receptacle comprises a container and an adapter portion to enable the applicator portion to be fixed on the receptacle, the applicator portion being removably mounted on the adapter portion, said adapter portion comprising a part made separately from the container and fixed thereon, and wherein the adapter portion has a covering skirt configured for extending around a neck of the container, and a receiver skirt for receiving the applicator portion.

48. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the receptacle comprises a container and an adapter portion to enable the applicator portion to be fixed on the receptacle, the applicator portion being removably mounted on the adapter portion, wherein the adapter portion has two main faces and comprises a recess formed in each of said faces, and wherein the applicator portion has an index, said index being suitable for engaging in one or other of the said recesses to inform the user about the position of the applicator portion relative to the receptacle.

49. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the receptacle comprises a container and an adapter portion to enable the applicator portion to be fixed on the receptacle, the applicator portion being removably mounted on the adapter portion, wherein the adapter portion has at least one indication molded therein for enabling the user to identify the position of the applicator portion relative to the receptacle.

50. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the receptacle comprises a container and an adapter portion to enable the applicator portion to be fixed on the receptacle, the applicator portion being removably mounted on the adapter portion, wherein the applicator portion has an assembly skirt and wherein the adapter portion is configured to enable the user to deform the assembly skirt by pressing in opposite directions on bearing surfaces so as to modify the engagement between the receptacle and the applicator portion, for the purpose of removing it.

51. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, wherein the receptacle has a plurality of substance delivery ducts and the applicator portion has a plurality of shutters suitable for engaging in said ducts to shut them when the applicator portion is in a first position, and suitable for taking up positions outside said ducts when said applicator portion is in a second position.

52. A device according to claim 43, wherein gaps between the teeth are chosen such that they allow hairs to pass between the teeth while enabling the substance to be retained within said curve.

53. A device according to claim 44, wherein gaps between the teeth are chosen such that they allow hairs to pass between the teeth while enabling the substance to be retained within said curve.

54. A device according to claim 45, wherein gaps between the teeth are chosen such that they allow hairs to pass between the teeth while enabling the substance to be retained within said curve.

55. A device according to claim 46, wherein gaps between the teeth are chosen such that they allow hairs to pass between the teeth while enabling the substance to be retained within said curve.

56. A device according to claim 47, wherein gaps between the teeth are chosen such that they allow hairs to pass between the teeth while enabling the substance to be retained within said curve.

57. A device according to claim 48, wherein gaps between the teeth are chosen such that they allow hairs to pass between the teeth while enabling the substance to be retained within said curve.

58. A device according to claim 49, wherein gaps between the teeth are chosen such that they allow hairs to pass between the teeth while enabling the substance to be retained within said curve.

59. A device according to claim 50 wherein gaps between the teeth are chosen such that they allow hairs to pass between the teeth while enabling the substance to be retained within said curve.

60. A device according to claim 51, wherein gaps between the teeth are chosen such that they allow hairs to pass between the teeth while enabling the substance to be retained within said curve.

61. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, gaps between the teeth being such that they allow hairs to pass between the teeth while enabling the substance to be retained within said curve and wherein the applicator portion has two outer rows and at least one intermediate row situated between said outer rows, said outer rows meeting each other around said at least one intermediate row.

62. A device for applying a substance to the hair, the device comprising:

a receptacle configured for containing the substance to be applied, and an applicator portion fixed on said receptacle and having at least one delivery orifice enabling the substance to be delivered, wherein the applicator portion has teeth arranged around a closed curve, gaps between the teeth being such that they allow hairs to pass between the teeth while enabling the substance to be retained within said curve, and wherein said closed curve has two longitudinal ends, the closed curve having a single tooth at each of said longitudinal ends.

* * * * *

UNITED STATES PATENT AND TRADEMARK OFFICE

CERTIFICATE OF CORRECTION

PATENT NO. : 7,000,618 B2 
DATED : February 21, 2006
INVENTOR(S) : Dovergne et al.

It is certified that error appears in the above-identified patent and that said Letters Patent is hereby corrected as shown below:

Title page,
Insert Item:
-- [30] Foreign Application Priority Data
08/31/2001 (FR) 0111340 --.

Signed and Sealed this

Sixth Day of June, 2006

JON W. DUDAS
*Director of the United States Patent and Trademark Office*